US005961428A

United States Patent [19]

Webber

[11] Patent Number: 5,961,428

[45] Date of Patent: Oct. 5, 1999

[54] LEG EXERCISE ARM FOR EXERCISE MACHINE

[76] Inventor: Randall T. Webber, 11162 Morning Creek Dr. South, San Diego, Calif. 92128

[21] Appl. No.: 09/014,860

[22] Filed: Jan. 29, 1998

[51] Int. Cl.[6] ..... A63B 21/00

[52] U.S. Cl. ..... 482/100; 482/102; 482/137; 482/138

[58] Field of Search ..... 482/97, 100–103, 482/104, 137, 138, 94

[56] References Cited

U.S. PATENT DOCUMENTS

| | | | |
|---|---|---|---|
| D. 303,558 | 9/1989 | Alessandri . | |
| 4,256,302 | 3/1981 | Keiser et al. | 482/100 |
| 4,678,185 | 7/1987 | Mahnke . | |
| 4,848,915 | 8/1989 | Szabo . | |
| 4,915,377 | 4/1990 | Malnke et al. . | |
| 4,949,951 | 8/1990 | Deola . | |
| 5,236,406 | 8/1993 | Webber . | |
| 5,395,295 | 3/1995 | Ish, III . | |
| 5,549,530 | 8/1996 | Fulks | 482/100 |
| 5,653,669 | 8/1997 | Cheng | 482/138 X |
| 5,733,229 | 3/1998 | Dalebout et al. | 482/138 X |

FOREIGN PATENT DOCUMENTS

| | | | |
|---|---|---|---|
| 0 270 131 | 6/1988 | European Pat. Off. | 482/137 |

OTHER PUBLICATIONS

*Bodylift Pro–Form—Owner's Manual*, 1994, Sears, Roebuck and Co., Hoffman Estates, Il 60179.

*Body Focus Body Weight Resistance System—Owner's Manual* (Revised), 1994, Weslo, Inc., a Subsidiary of Weider Health and Fitness, Inc.

*Newport* brochure, Jul. 1996, Pacific Fitness, Cypress, CA.

Cybex brochure, Product #5634.

Pacific Fitness Malibu.

Pacific Fitness *Del Mar*.

B–700 Gym.

Maxicam, Muscle Dynamics.

Pacific Fitness Catalina.

Freeform Prolink.

Muscle 3, Tuff Stuff.

Multi Function Home Gym 880–3D, Hoist Fitness Systems.

Master Trainer 1A, Body Masters Sports Industries, Inc.

Vectra C–1.

Marcy EM–1.

Cybex Personal.

Hoist Fitness Systems.Hoist 440 Multi–Function Gym Brochure © 1995.

*Primary Examiner*—John Mulcahy

*Attorney, Agent, or Firm*—Brown Martin Haller & McClain LLP

[57] ABSTRACT

An apparatus for performing exercises has a support frame and a seat mounted on the support frame. An exercise arm is pivoted adjacent the forward end of the seat for swinging back and forth in front of the seat, and has a curved portion which curves forwardly in a direction away from the seat. A pulley to which a load bearing cable is secured is mounted at the curved forward end of the arm. A pair of leg engaging roller pads are adjustably or rigidly attached to the arm for engagement by an exerciser's legs while performing different exercises. A handle can be releasably attached to the cable or to the exercise arm for performing upper body exercises.

30 Claims, 12 Drawing Sheets

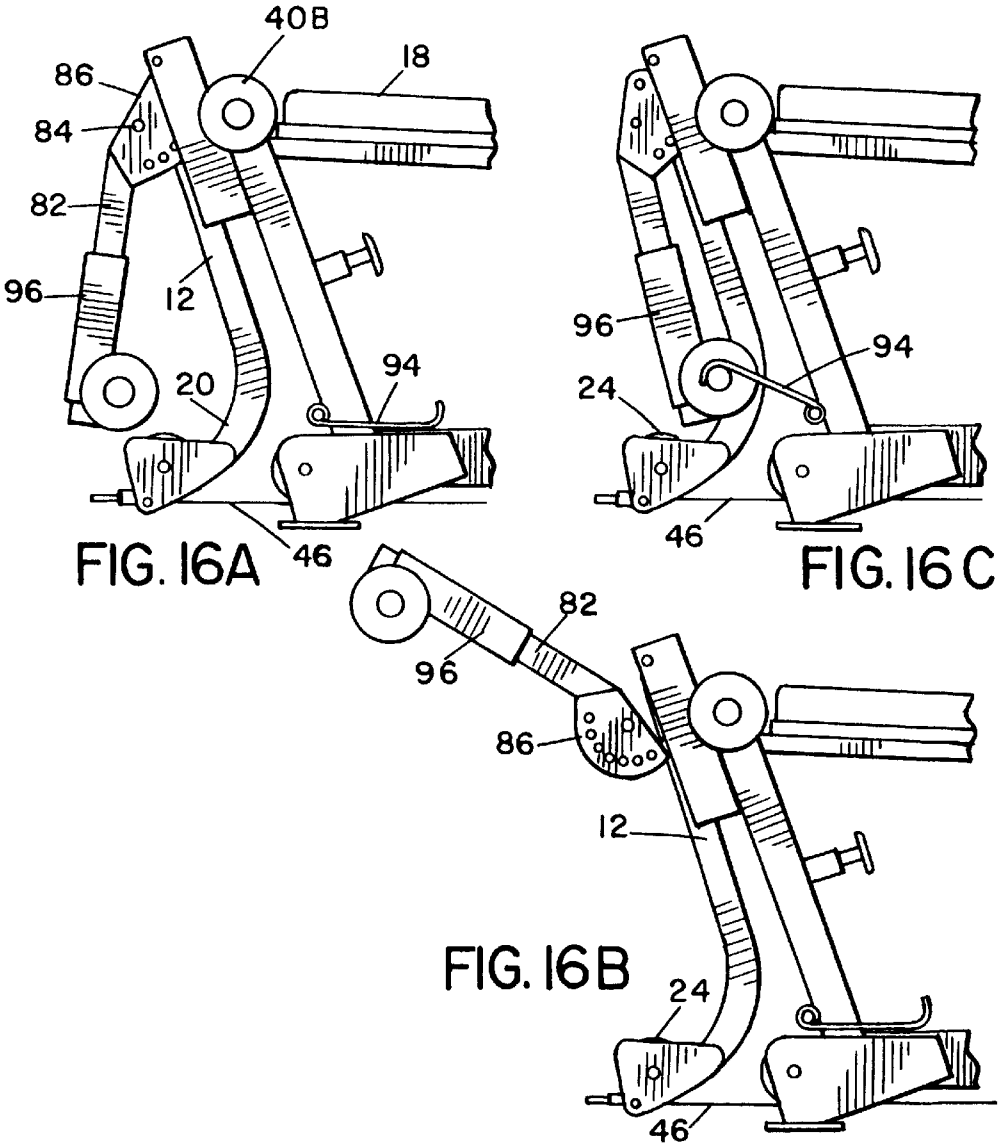
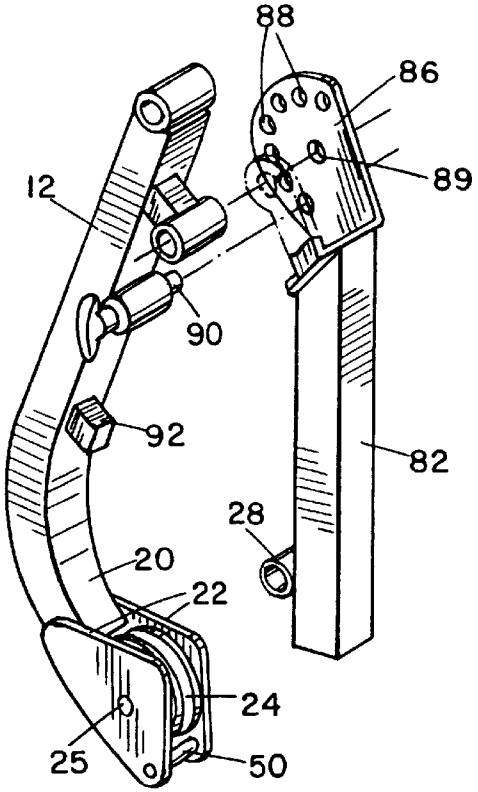
FIG. 15

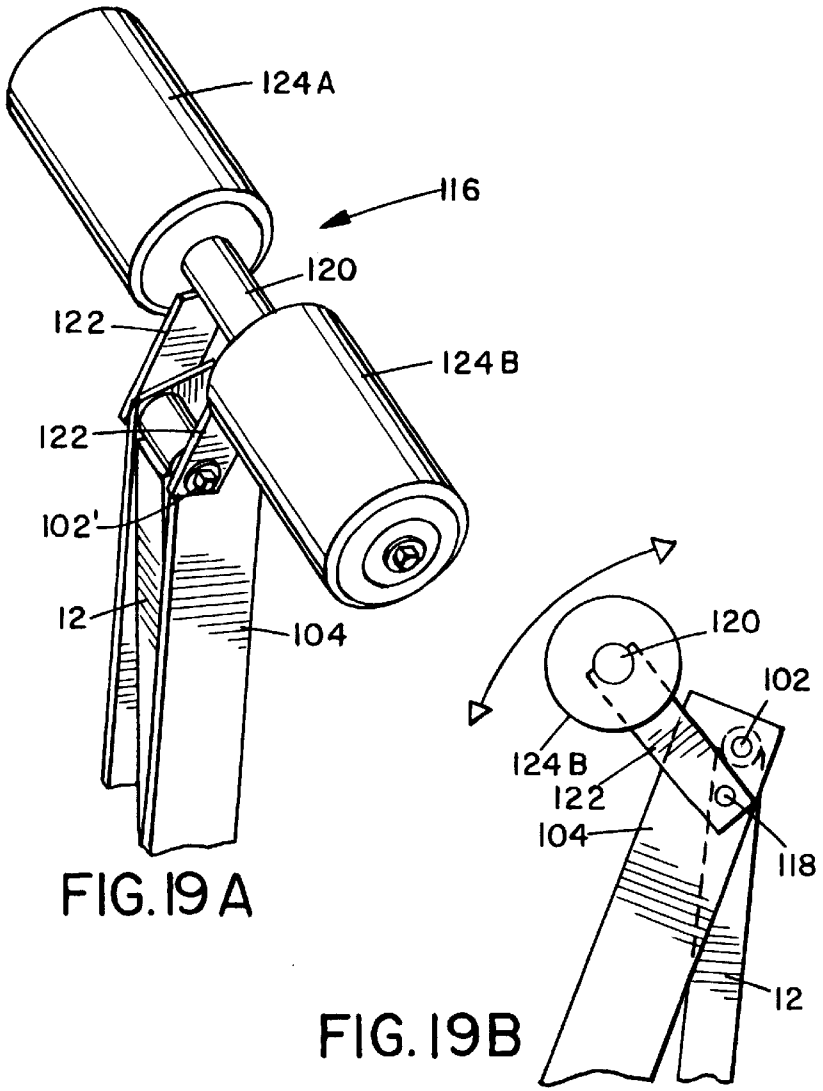
FIG. 19A
FIG. 19B
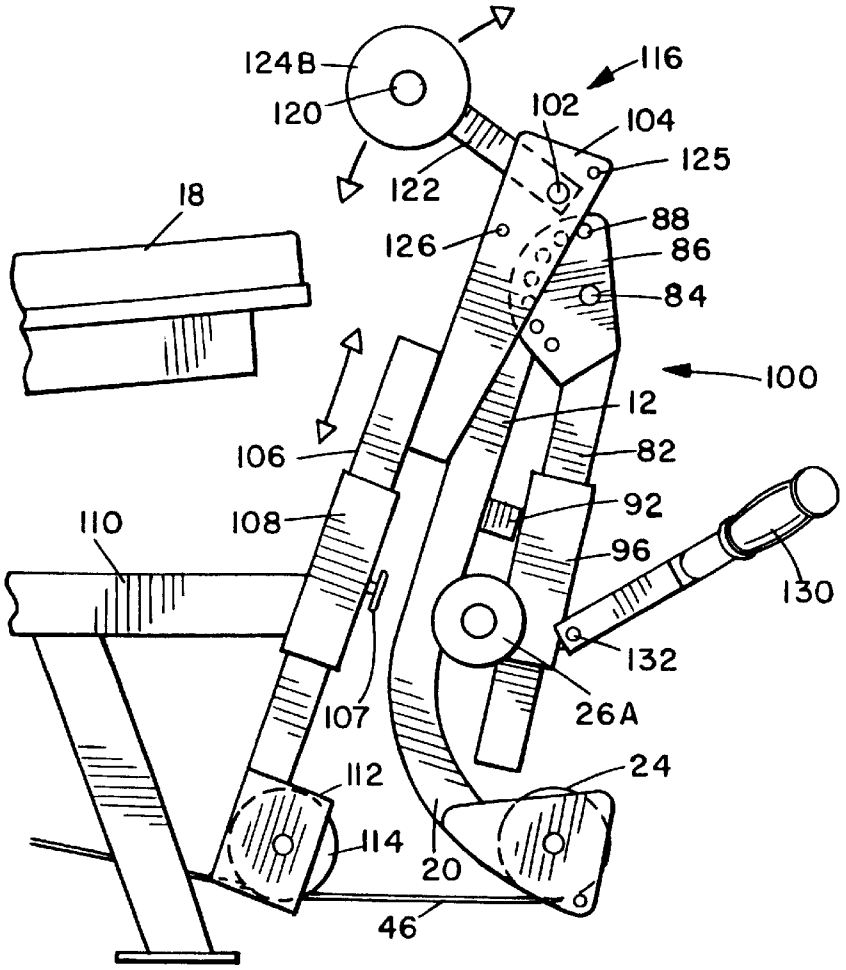
FIG. 18

LEG EXERCISE ARM FOR EXERCISE MACHINE

BACKGROUND OF THE INVENTION

The present invention relates generally to weight lifting exercise machines, and is particularly concerned with a leg exercise arm for such machines.

Weight lifting machines normally have a leg extension/leg curl arm pivoted at the front end of the machine adjacent the seat and linked to the exercise resistance to permit a user to perform leg exercises. Such devices are described, for example, in U.S. Pat. Nos. 4,678,185 and 4,915,377 of Mahnke. The exercise arm in these machines is straight. In some prior art leg exercise arms, a pulley is mounted on the straight arm, for example the 880-3D Home Gym of Hoist Fitness Systems has a pulley at the end of the straight exercise arm. The problem with straight leg exercise arms is that the exerciser will experience a drop off or reduction in resistance while performing an exercise. This is because the exercise arm goes through an arcing motion, and the cable attached to the arm is therefore not pulled at a constant rate. In order to prevent the drop off in resistance, some manufacturers have attached a cam or curved piece of metal to the end of the exercise arm, providing a surface for the cable to wrap around during the second half of an exercise movement, so that the cable is pulled at an even rate during the entire movement. However, this adds to the expense of the machine and also causes design restrictions due to the rearward protrusion of the cam.

The straight leg exercise arm also has a second disadvantage when a pulley is mounted at the end of the arm for performing other exercises such as upper body, standing position exercises. The user stands facing the machine and pulls the cable upward using various handle attachments. In order to perform such exercises, the exerciser must stand back from the machine to avoid damaging the cable by rubbing it against the front of the machine. This requires additional floor space. It can also be difficult to access the cable attachment point if the pulley is located at the end of the straight arm.

One possible solution to these problems is to mount the pulley on the bottom front of the exercise arm. However, this will cause the cable to rub against, or bend round, the bottom of the exercise arm when in use, unless a cam is attached to prevent this. Another solution is to eliminate the pulley at the lower end of the exercise arm altogether, and to attach the cable permanently to this arm. In this case, another location must be provided on the machine for performing the additional upper body exercises.

SUMMARY OF THE INVENTION

It is an object of the present invention to provide a new and improved leg exercise arm for a weight lifting machine.

According to the present invention, an apparatus for performing exercises is provided which comprises a seat having a forward end, an arm having a first end pivoted adjacent the forward end of the seat for swinging back and forth in front of the seat, and a second end, the arm having a curved portion adjacent the second end which curves forwardly in a direction away from the seat, a pulley mounted at the second end of the arm for engagement with a cable linking the arm to an exercise resistance, and a leg engaging assembly attached to the arm, the leg engaging assembly comprising a pair of oppositely directed leg engagement members for engagement by the legs of a user on opposite sides of the arm.

Preferably, the leg engagement members comprise a pair of oppositely directed roller pads secured to the arm above the curved portion. The roller pads may be adjustably secured to the arm by means of a sliding sleeve or a hinged member, to accommodate users with different leg lengths. In an alternative embodiment, the leg engaging assembly may comprise an elongate, second arm pivotally mounted adjacent the first end of the first arm, and releasably securable to the first arm by means of a range of motion or ROM device in any one of a series of angular positions relative to the first arm. The leg engagement members are mounted at the free end of the second arm. In this arrangement, the first, curved arm comprises the load bearing arm and the second arm comprises the leg engagement arm. The exerciser can adjust the starting position of the leg engagement arm to any desired orientation, without affecting the load bearing arm.

In this invention, a forward curving exercise arm is provided with a pulley mounted on the forward end of the arm, with the forwardly curved portion of the arm acting like a cam and providing a surface for the cable to wrap around during the second half of an exercise movement, avoiding any drop off in resistance. This arrangement also places the cable attachment point out in front of the exercise arm for easier access to attach handles to perform upper body exercises, and allows the exerciser to stand closer to the machine without damaging the cable. The pulley on the forward end of the exercise arm allows the cable to wrap around the curved portion of the arm when performing leg extensions or standing leg curls, and at the same time permits unrestricted movement of the cable when pulled by itself for performing additional exercises.

BRIEF DESCRIPTION OF THE DRAWINGS

The present invention will be better understood from the following detailed description of some preferred embodiments of the invention, taken in conjunction with the accompanying drawings, in which like reference numerals refer to like parts, and in which:

FIG. 15 is an exploded perspective view illustrating the range of motion device of FIGS. 13 and 14 in more detail;

FIGS. 16A to 16C are side elevation views illustrating several alternative positions of the leg engaging arm of FIGS. 13 to 15;

FIG. 18 is a side elevation view of a leg exercise arm assembly according to another embodiment of the invention;

FIG. 19A is a partial perspective view illustrating a modification of the adjustable roller pad at the upper end of the assembly of FIG. 18;

FIG. 19B is a side elevation view illustrating a modified upper roller pad arrangement;

DESCRIPTION OF THE PREFERRED EMBODIMENT

Figure 2:
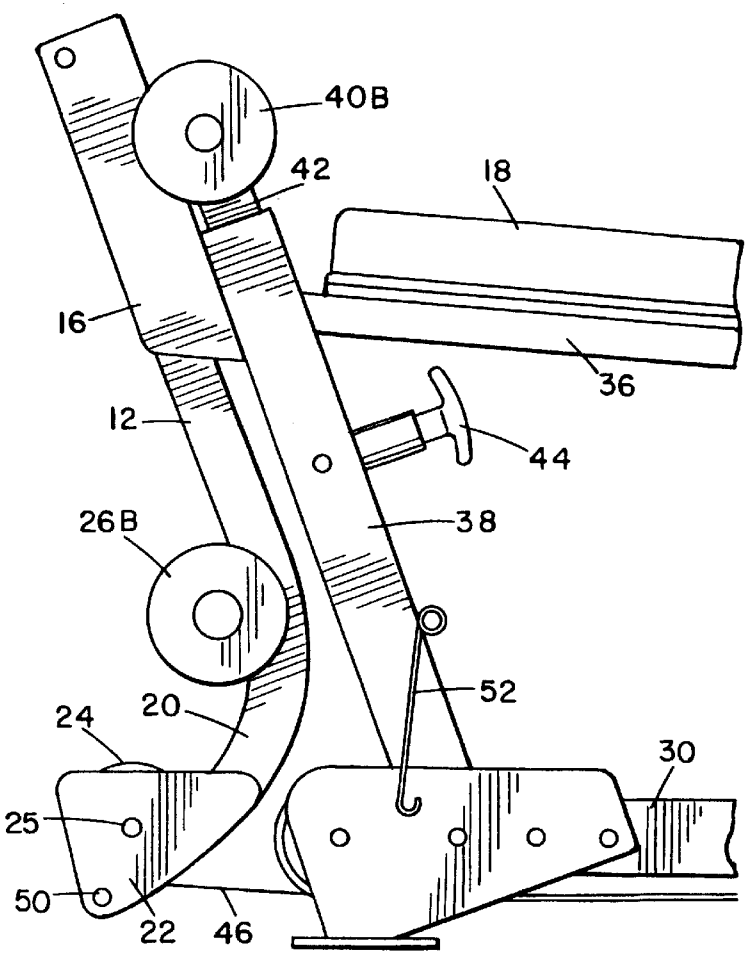
FIG. 2 is a side elevation view of the leg exercise arm of FIG. 1.
Figure 1:
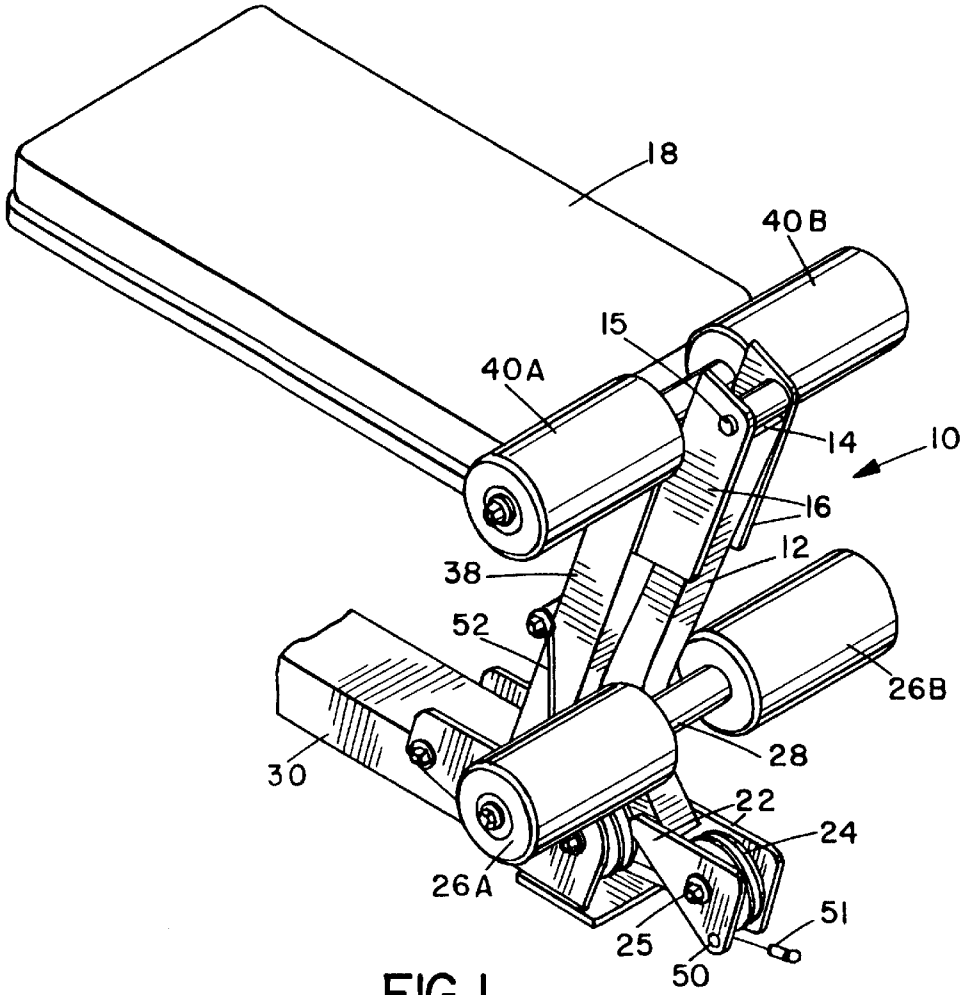
FIG. 1 is a perspective view of a leg exercise arm according to a first embodiment of the invention mounted at the forward end of the seat portion of an exercise machine.

FIGS. 1 and 2 of the drawings illustrate a leg exercise arm assembly according to a first embodiment of the present invention, while FIGS. 3A, 4, 5, 6 and 8 illustrate use of the exercise arm in performing various exercise motions.

Figure 3A:
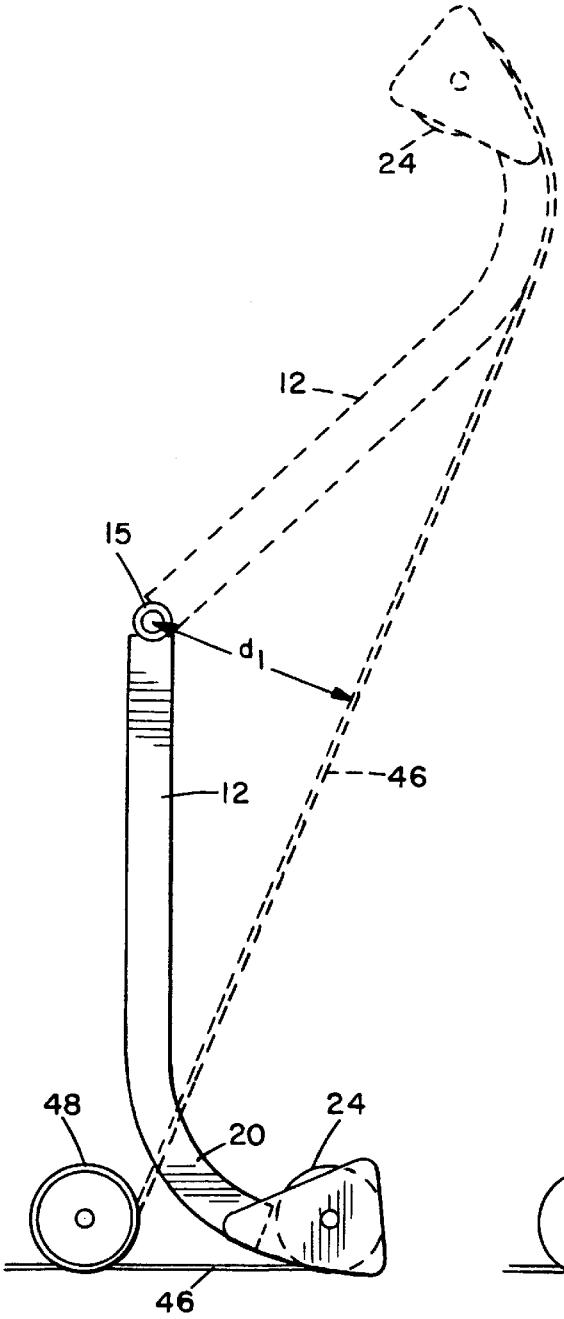
FIG. 3A is a partial side elevation view illustrating movement of the arm of FIGS. 1 and 2 from a start position to a fully extended position.

The exercise arm assembly 10 basically comprises an elongate arm 12 having a first end 14 pivoted via pivot pin 15 between a pair of forward end brackets 16 of a seat 18 on a weight lifting machine, and a curved second end portion 20 curving forwardly from the seat 18. As illustrated in FIGS. 1, 2 and 3A, the arm is formed in one piece, with an integral curved portion 20. The curved end portion 20 terminates in a second end on which a pair of pulley mounting brackets 22 are mounted. A pulley 24 is secured between brackets 22 by bolt 25. A pair of leg engaging roller pads 26A and 26B are mounted on axle 28 which is secured to the forward side of arm 12 just above the beginning of forwardly curved portion 20, as best illustrated in FIG. 2.

The leg exercise assembly 10 may be pivotally mounted at the forward end of the seat portion of any weight lifting machine. Such machines typically comprise a support frame with a base including forwardly extending base strut 30, an upright 32, and an upper strut 34, as generally indicated in FIGS. 4 to 6 and 8. A seat supporting strut 36 projects forwardly from upright 32 to support seat pad 18.

Preferably, a forwardly inclined strut 38 is rigidly mounted on base strut 30 to extend upwardly at the forward end of seat 18, and is also secured to the forward end of the seat supporting strut 36, as indicated in FIG. 2. Strut 38 is a hollow, square section tubular member, and a pair of leg engaging roller arms 40A, 40B are secured to the end of an adjustment shaft 42 which engages telescopically in the upper open end of strut 38. A pull pin 44 extends through aligned openings in strut 38 and rod 42 to secure the roller pads 40A, 40B in a desired extended position. The mounting brackets 16 for arm 12 are rigidly mounted on the forward side of strut 38.

A weight stack or other exercise resistance is provided on the exercise machine in a standard manner. The weight stack is linked to each exercise device in the machine by means of a cable and pulley mechanism. Pulley 24 is linked to the exercise resistance by means of a suitable load-bearing cable 46 which extends along the base of the machine forwardly via guide pulley 48 to pulley 24, as illustrated in FIG. 1. The cable runs under pulley 24 and is held in place by a cable stop bolt 50. Cable 46 has a ball stop and attachment point 51 at its face end and may be linked to a load either directly or indirectly through other cables and pulleys.

A latch or hook member 52 may be hinged to strut 38 as illustrated in FIG. 1. The latch member 52 may be hooked around axle 28 when the assembly is in the rest position illustrated, so as to prevent movement of the exercise arm when the cable attachment is used to perform other exercises.

Figure 3B:
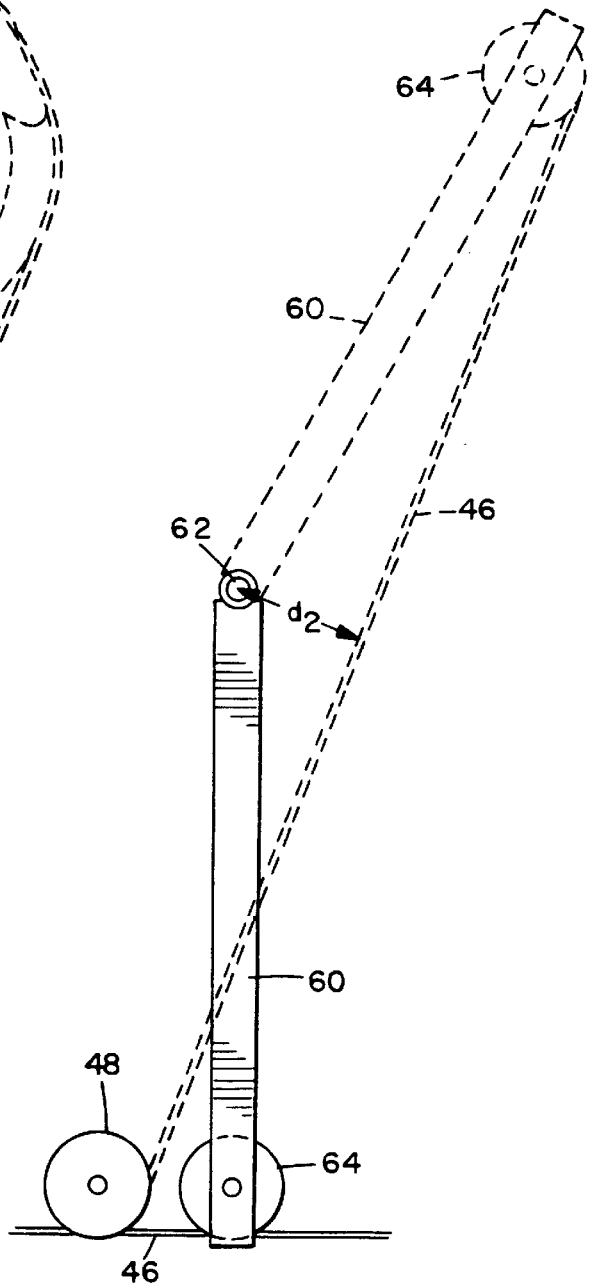
FIG. 3B PRIOR ART
FIG. 3B is a view similar to FIG. 3A illustrating a corresponding movement of a prior art leg exercise arm.

The advantage of the leg exercise arm 12 of this invention with the curved, forwardly projecting portion 20 is best illustrated in FIGS. 3A and 3B, where FIG. 3A illustrates the motion of arm 1 2 and FIG. 3B illustrates the corresponding motion of a prior art, straight leg exercise arm 60. The straight exercise arm 60 is pivoted at one end via pivot 62 to the front of the seat of an exercise machine, and has a pulley 64 at the opposite end around which the load bearing cable 46 extends. The start position of each exercise arm 12,60 is shown in solid lines in FIGS. 3A and 3B, while the finished or fully extended position is shown in dotted lines. In the prior art arrangement, there will be a drop off in exercise resistance because the first half of the movement will pull more cable than the second half. With the exercise assembly of FIGS. 1,2, and 3A, this drop off is avoided, as can be seen from a comparison of the distance of the center of the exercise arm pivot 15,62 to the cable 46 in the fully extended position, denoted by $d_1$ in FIG. 3A and $d_2$ in FIG. 3B. The distance d, is 60% greater than the distance $d_2$. This translates into a 60% increase in load resistance throughout the exercise movement, which greatly reduces the feeling of resistance "drop off".

Figure 4:
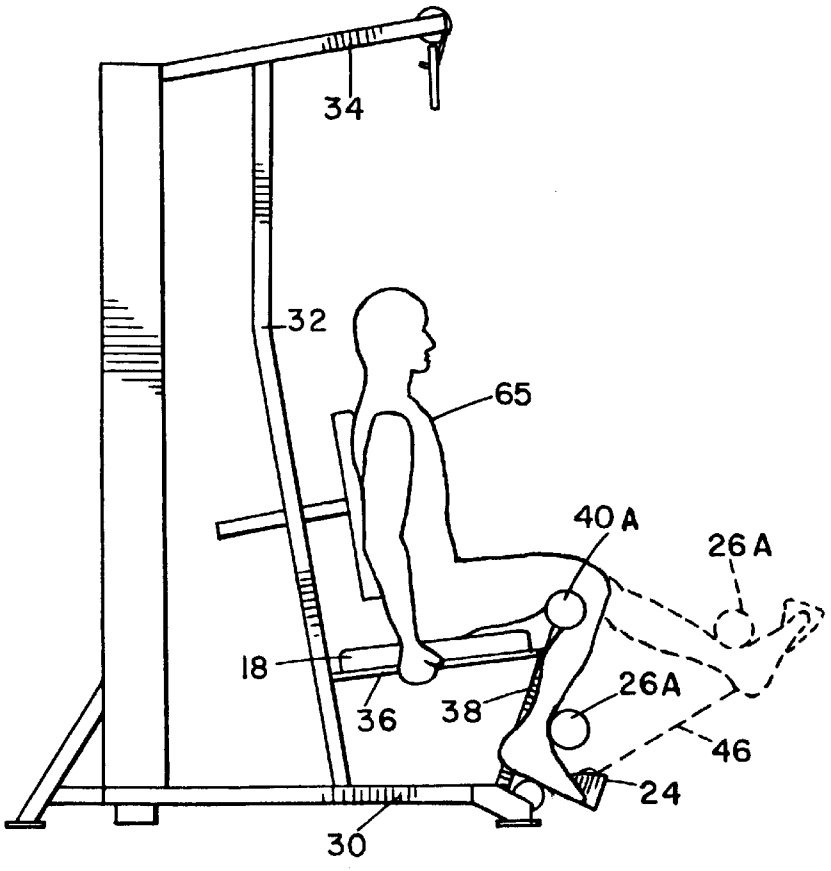
FIG. 4 is a side elevation view illustrating an exerciser performing a leg extension exercise using the exercise arm of FIGS. 1 to 3A.

Other advantages of the arrangement of FIGS. 1 to 3A over the prior art are illustrated in FIGS. 4 to 9. FIG. 4 illustrates an exerciser 65 performing a leg extension exercise using the exercise arm assembly of FIGS. 1 to 3A. The exerciser is seated on seat 18 while performing this exercise, with the legs engaging over pads 40A,40B at the knee joint and behind pads 26A, 26B at the ankles. The exerciser will move their legs back and forth between the solid line position and the dotted line position indicated in FIG. 4.

Figure 5:
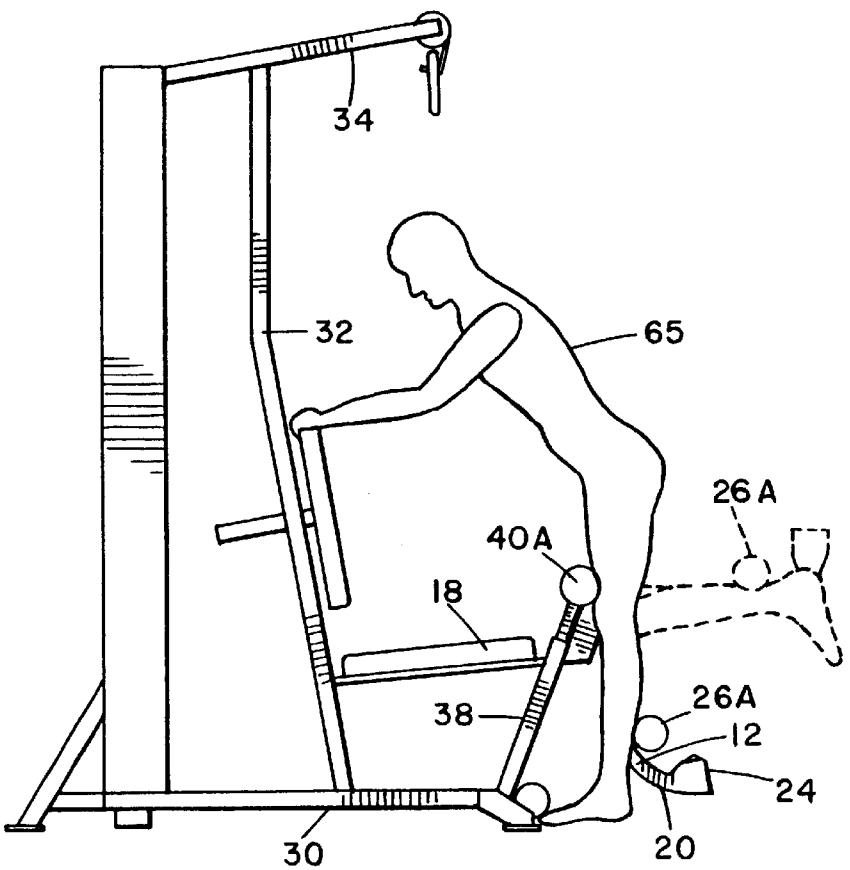
FIG. 5 is a side elevation view similar to FIG. 4 illustrating performance of a standing leg curl exercise.

FIG. 5 illustrates performance of a standing leg curl using the exercise arm assembly of FIGS. 1 to 3A. Exerciser 65 stands facing the machine with their upper thighs resting against pads 40A, 40B and the back of their legs engaging pads 26A,26B above the ankles. The legs are then kicked back in turn between the solid line position and the dotted line position.

Figure 7:
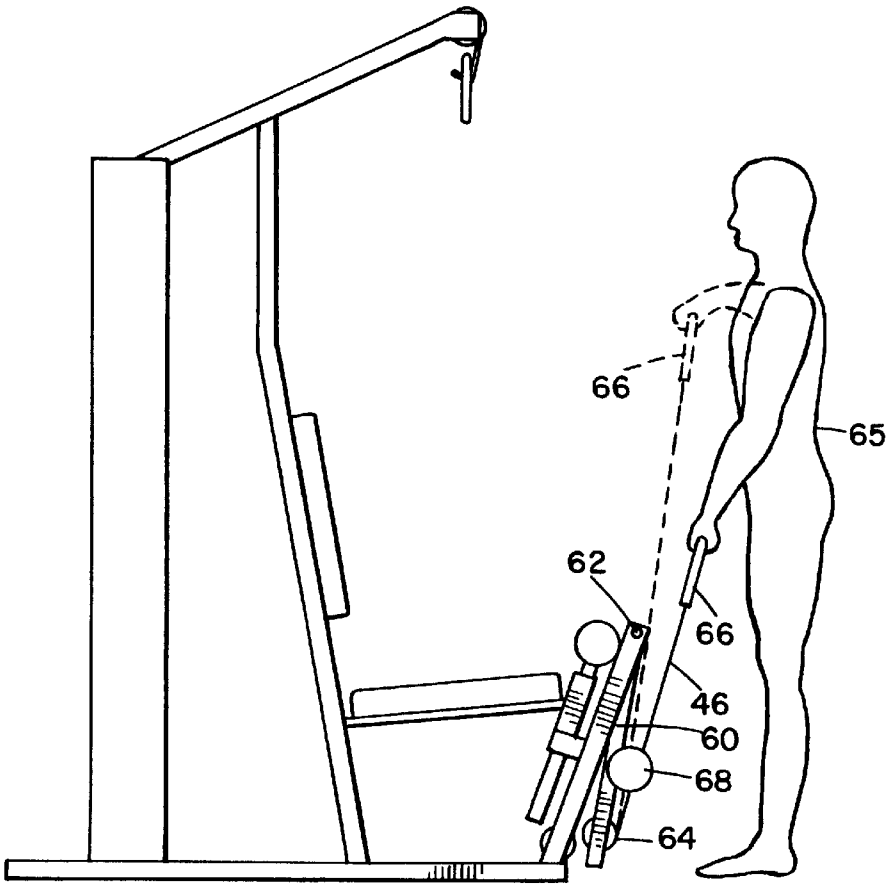
FIG. 7 PRIOR ART
FIG. 7 is a side elevation view similar to FIG. 6 illustrating performance of the same exercise using a prior art exercise arm.
Figure 6:
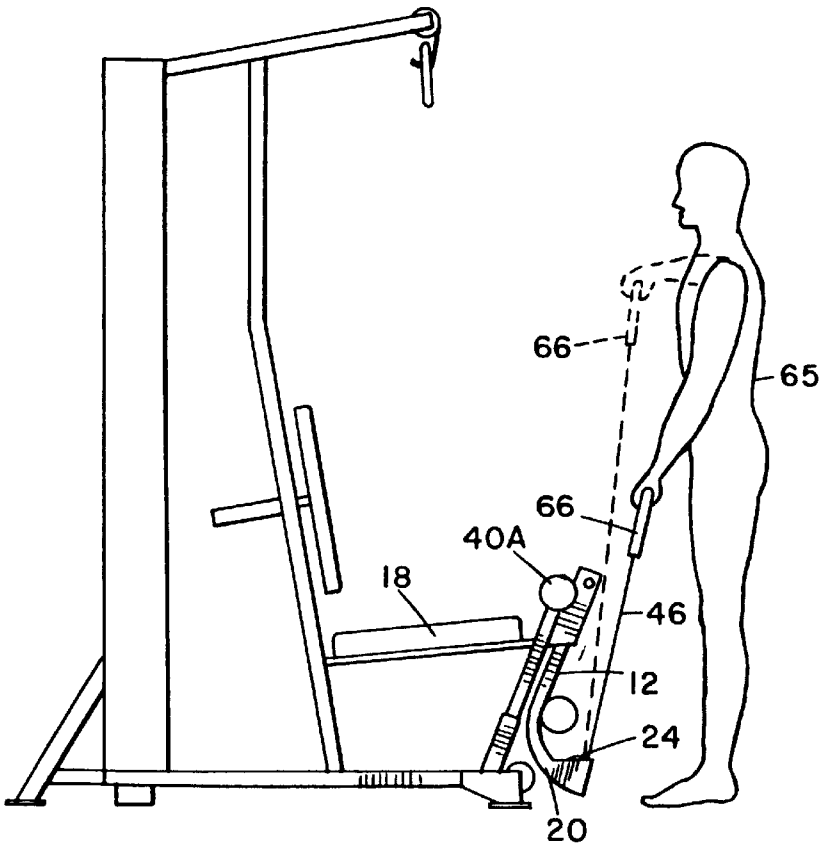
FIG. 6 is a side elevation view similar to FIGS. 4 and 5 illustrating performance of an upright row exercise.

FIG. 6 illustrates performance of an upright row exercise using the curved exercise arm 1 2 of this invention, while FIG. 7 illustrates performance of the same exercise using the prior art, straight exercise arm 60. A handle 66 is attached to the attachment device 51 at the end of the cable 46 in order to perform this exercise. The exerciser 65 faces the machine and grips the handle 66 with both hands. The arms are then moved between the solid line position illustrated in FIG. 6 and the dotted line position. It can be seen that the cable 46 is completely clear of the exercise arm 12 throughout this movement, since the cable attachment point is shifted forwardly by the forwardly curved end portion 20 of arm 12.

FIG. 7 illustrates use of a straight exercise arm 60 as in FIG. 3B to perform the same exercise as in FIG. 6. A pair of leg engaging pads 68 are secured at opposite ends of an axle or tube (not visible in the drawings), which is secured transversely across the front side of arm 60 to mount the pads 68 in a suitable position to engage the user's legs when performing seated or standing leg exercises. As in FIG. 6, the exerciser 65 will stand facing the machine, grip handle 66, and pull up on the cable between the solid line position and the dotted line position. However, it can be seen that the cable 46 will tend to hit the axle or tube supporting pads 68 when in the dotted line, fully extended position of FIG. 7. This can cause damage to the cable. The exerciser would have to stand further back to avoid this problem, and the machine would therefore require more floor space.

Another advantage of the curved forward end portion 20 of arm 12 is that it makes the cable attachment point 51 for auxiliary devices such as handle 66 easier to access. When the attachment point is on pulley 64 at the end of a straight arm 60, as in FIG. 7, the attachment point will be beneath the pulley and can be difficult to reach. With the curved exercise arm of this invention, the attachment point is raised up and forward of the pulley 24, making it easy to reach.

Figure 9:
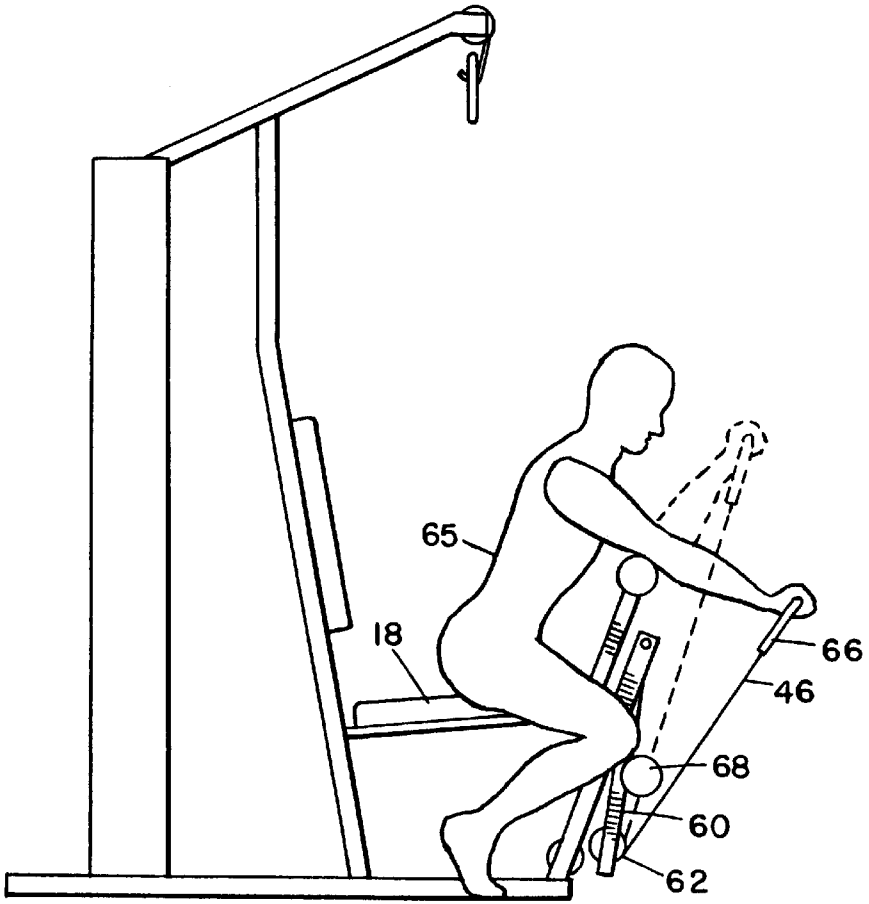
FIG. 9 PRIOR ART
FIG. 9 is a side elevation view similar to FIG. 8 illustrating performance of the same exercise using the prior art exercise arm of FIGS. 3B and 7.
Figure 8:
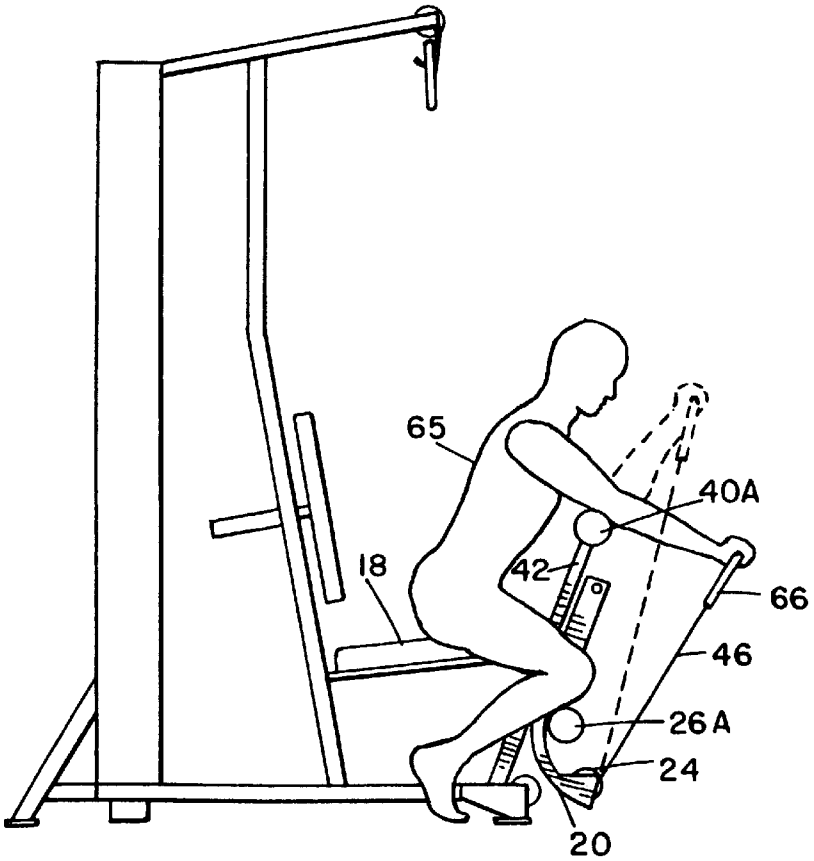
FIG. 8 is a side elevation view similar to FIGS. 4 to 6 illustrating performance of a preacher curl exercise.

FIG. 8 illustrates use of the exercise arm assembly of FIGS. 1 to 3A to perform a preacher curl exercise, while FIG. 9 illustrates an equivalent exercise using the prior art exercise arm 60 of FIG. 3B. As illustrated in FIG. 8, the exerciser 65 is seated on seat 18 for this exercise, and reaches forwards to grip handle 66. The exerciser then pulls up on the cable to move between the solid line position and the dotted line position. Again, the curved forward end portion 20 of the exercise arm 1 2 will shift the handle attachment point forwardly from the straight part of arm 12, ensuring that the cable 46 is completely clear of the forward end of the machine during the entire movement. In the prior art arrangement of FIG. 9, it can be seen that the cable will tend to hit the front of the roller pad mount during the exercise movement, which is not a problem with the apparatus of FIG. 8.

The exercise assembly of FIGS. 1 to 3A therefore has several advantages over the prior art arrangement. First, it reduces the experience of drop off or reduction in resistance while performing an exercise with a leg exercise arm, which is a problem in conventional, straight leg exercise arms. Secondly, when a handle is attached for performing upper body exercises, the forwardly curved end portion 20 will hold the cable clear of the machine, reducing the space requirements and also reducing the risk of cable damage as a result of the cable hitting the front of the exercise arm. This arrangement allows the exerciser to stand closer to the front of the machine without damaging the cable, reducing the floor space required.

Figure 11:
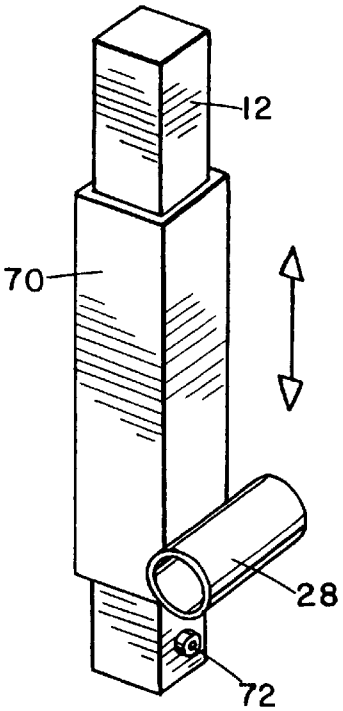
FIG. 11 is a partial perspective view of the leg exercise arm of FIG. 10 illustrating the adjustment sleeve of the leg engaging assembly.
Figure 10:
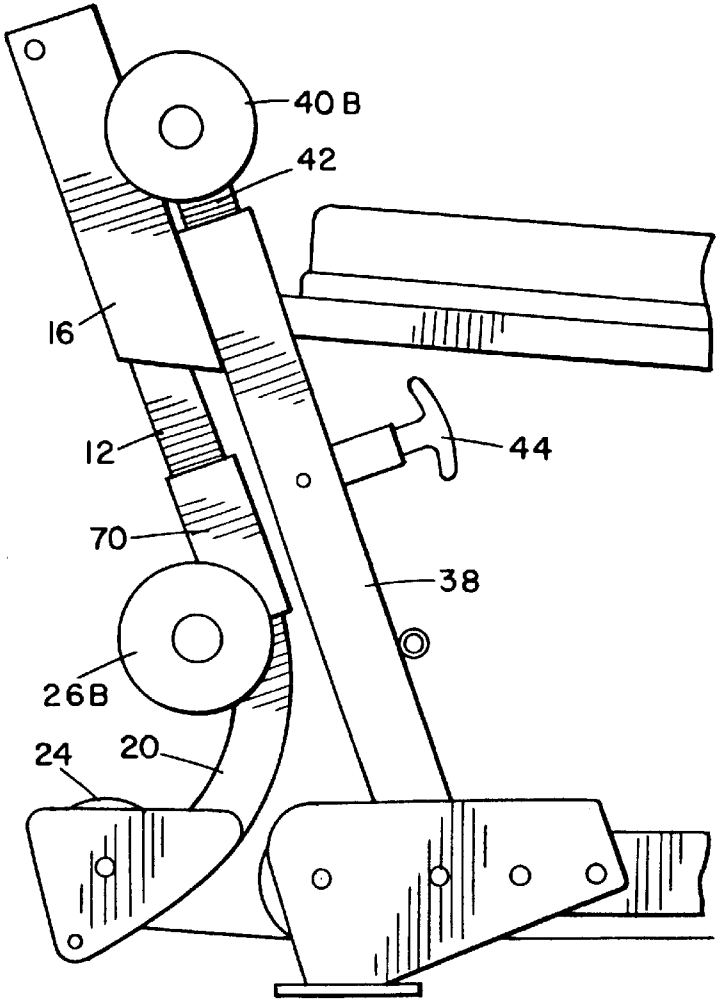
FIG. 10 is a side elevation view similar to FIG. 2 illustrating a modified leg exercise arm with a slidably adjustable leg engaging assembly.

FIGS. 10 and 11 illustrate a modification of the exercise arm assembly of FIGS. 1 to 3A. The modified assembly of FIGS. 10 and 11 is similar to that of FIGS. 1 to 3A, and like reference numerals have been used for like parts as appropriate. In the first embodiment, the axle or tube 28 was welded directly to the forward side of the exercise arm 1 2. In this modification, the round tube or axle 28 carrying pads 26A,26B is secured to a slider tube 70 which is slidably mounted over arm 12. Tube 70 slides up and down on arm 12 to adjust for exercisers with different leg lengths, and also to adjust the pad position during an exercise motion. Tube 70 slides freely up and down, rather than being fixed in an adjusted position as in some prior art arrangements, so that the pad position is self-adjusting and can move as required during an exercise movement. A stop pin 72 is secured to arm 12 just above the curved portion 20, to prevent the roller pad adjuster tube 70 from wedging itself onto the curved portion of the arm. Thus, the roller pad adjuster tube 70 is free to adjust up and down on the straight portion of arm 12.

Figure 12:
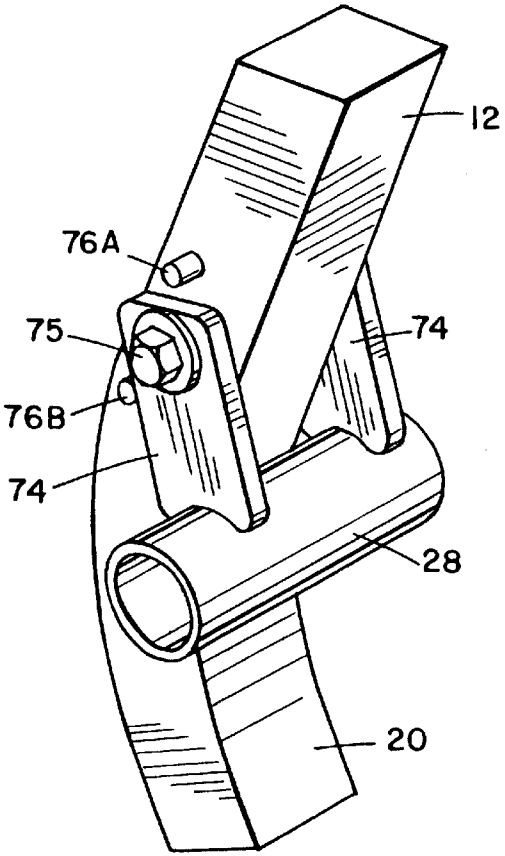
FIG. 12 is a partial perspective view of the leg exercise arm illustrating a modified adjustable leg engaging assembly.

FIG. 12 illustrates another modification in which the roller pad position is self-adjusting. In this case, the axle or tube 28 carrying the roller pads 26A and 26B is secured or welded to swivel brackets 74, which in turn are pivoted to the straight portion of arm 12 just above the curved portion 20, via pivot pin 75. This allows the tube 28 to pivot up and down about pin 75 to adjust the position of roller pads 26A,26B, either to accommodate user's with different leg lengths, or for self-adjustment during an exercise as the user's leg moves. Stops 76A and 76B are mounted on the arm 12 above and below the pivot 75 to limit the swing of the roller mounting tube 28, protecting the front face of the arm 12 from damage due to impact with the tube 28.

FIGS. 13 to 17 illustrate an exercise arm assembly 80 according to a second embodiment of the invention pivotally mounted at the front end of a seat supporting portion of an exercise machine frame in a similar manner to the first embodiment. Some parts of the assembly in FIGS. 13 to 17 are identical to those of the first embodiment, and like reference numerals have been used as appropriate. However, unlike the first embodiment, this embodiment has a range of motion adjustment to allow the exerciser to vary the starting position or pre-stretch of the exercise arm.

As in the first embodiment, the assembly 80 has an arm 12 pivoted at one end via pivot 15 to brackets 16 at the forward end of a seat supporting strut 36. The arm has a curved, forwardly projecting portion 20 at its lower end, with a pulley 24 secured between mounting brackets 22 at the forward end of portion 20. However, unlike the previous embodiment, the leg engaging roller pads 26A,26B are not mounted on arm 12. Instead, a straight adjustment arm 82 is rotatably secured at one end to the curved arm 12 via pivot pin 84, and the roller pad supporting axle or roller 28 is welded to the rear face of arm 82 so that the pads 26A,26B project on opposite sides of arm 82.

Figure 13:
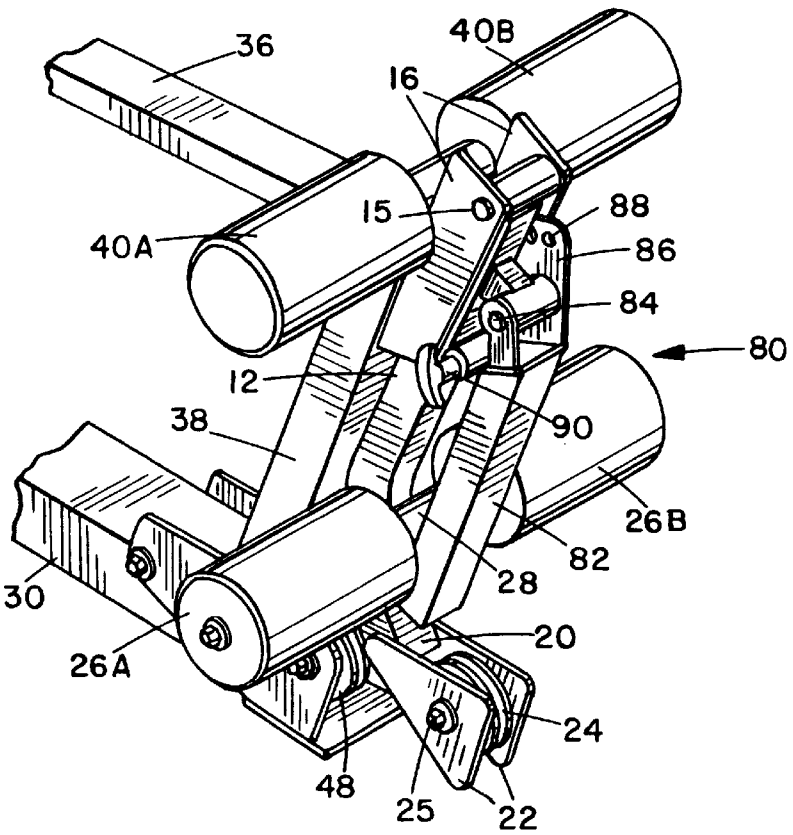
FIG. 13 is a perspective view of a leg exercise arm assembly according to another embodiment of the invention.

A range of motion plate 86 having a series of openings 88 arranged in an arc about the axis of pivot opening 89 is welded at the upper end of arm 82. A pull pin 90 is secured to the front of arm 12 adjacent the pivot mounting of arm 82, as best illustrated in FIGS. 13 and 15. The pin 90 will engage through any one of the openings 88 in order to secure the arm 82 at a desired orientation relative to the curved arm 12. The arm 82 is simply rotated to the desired position with the pull pin 90 retracted, and the pin 90 is then released to extend through the aligned opening 88.

A stop 92 is attached to the front side of arm 12 to prevent the adjustable arm 82 from striking the curved arm 12. Latch or hook 94 is pivoted to the lower end of strut 38 for latching the assembly 80 in a retracted position when not in use.

Figure 14:
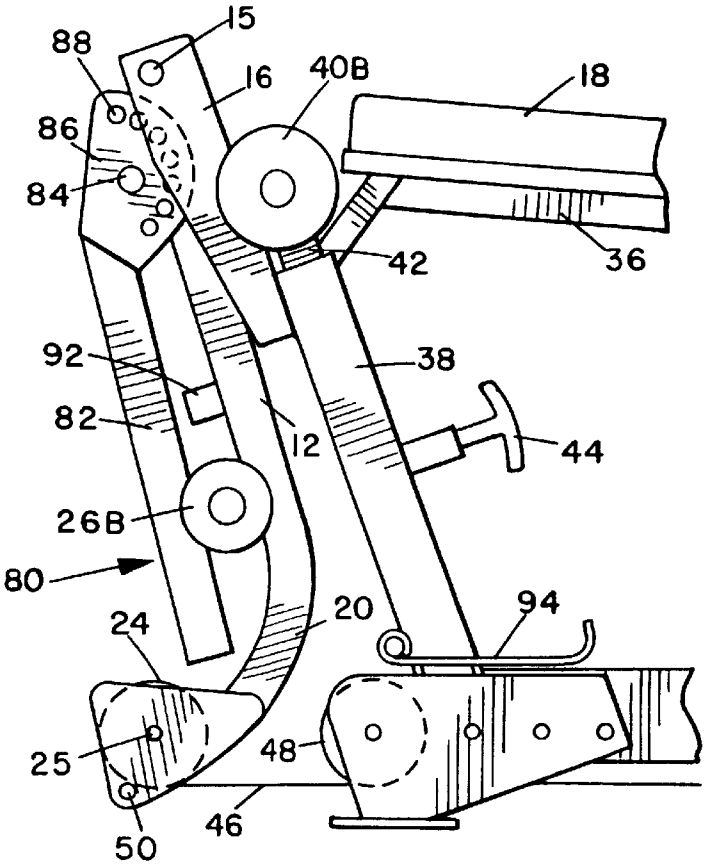
FIG. 14 is a side elevation view of the exercise arm of FIG. 13.

In FIGS. 13 to 15, the roller pad assembly comprising axle or mounting tube 28 and pads 26A and 26B is shown welded to the adjustable arm 82. However, it will be understood that the tube 28 may alternatively be adjustably mounted on the arm 82, in a similar manner to that described above in connection with FIGS. 10 to 12, i.e. by means of a sliding tube 96 as indicated in FIGS. 16A to 16C, or by means of a swivel bracket as in FIG. 12. This will permit the roller pads to adjust up and down on arm 82 to accommodate exercisers with different leg lengths, and also to accommodate different leg positions during an exercise movement, as described above in connection with FIGS. 10 and 11. A stop pin (not illustrated) will be provided adjacent the lower end of arm 82 to prevent the sleeve 96 from sliding off the arm, and to limit the movement of sleeve 96.

Adjustment of the angle of roller pad carrying arm 82 relative to the load carrying arm 12 allows the starting position of an exercise, and thus the amount of pre-stretch, to be varied. This allows the starting position to be varied for both leg extensions and leg curls, which can be important for novice exercisers, the elderly, and in clinical, post-operative re-habilitation situations, where the exerciser may not have the same joint and muscle flexibility as an experienced exerciser. The assembly also permits an exerciser to perform both standing and lying leg curls, as will be explained in more detail with reference to FIGS. 16 and 17.

FIGS. 16A, 16B and 16C illustrate some possible adjusted positions of arm 82 relative to the curved arm 12. In FIG. 16A, the arm 82 is inclined at an acute angle relative to arm 12 and locked in this position via pull pin 90. This position is suitable for performing standing leg curls with a full pre-stretch or for performing leg extensions with slightly less pre-stretch than when the arm is in the position illustrated in FIG. 14. The arm 82 may be inclined at increasing angles to arm 12 to define a start position for users with reducing flexibility.

Figure 17:
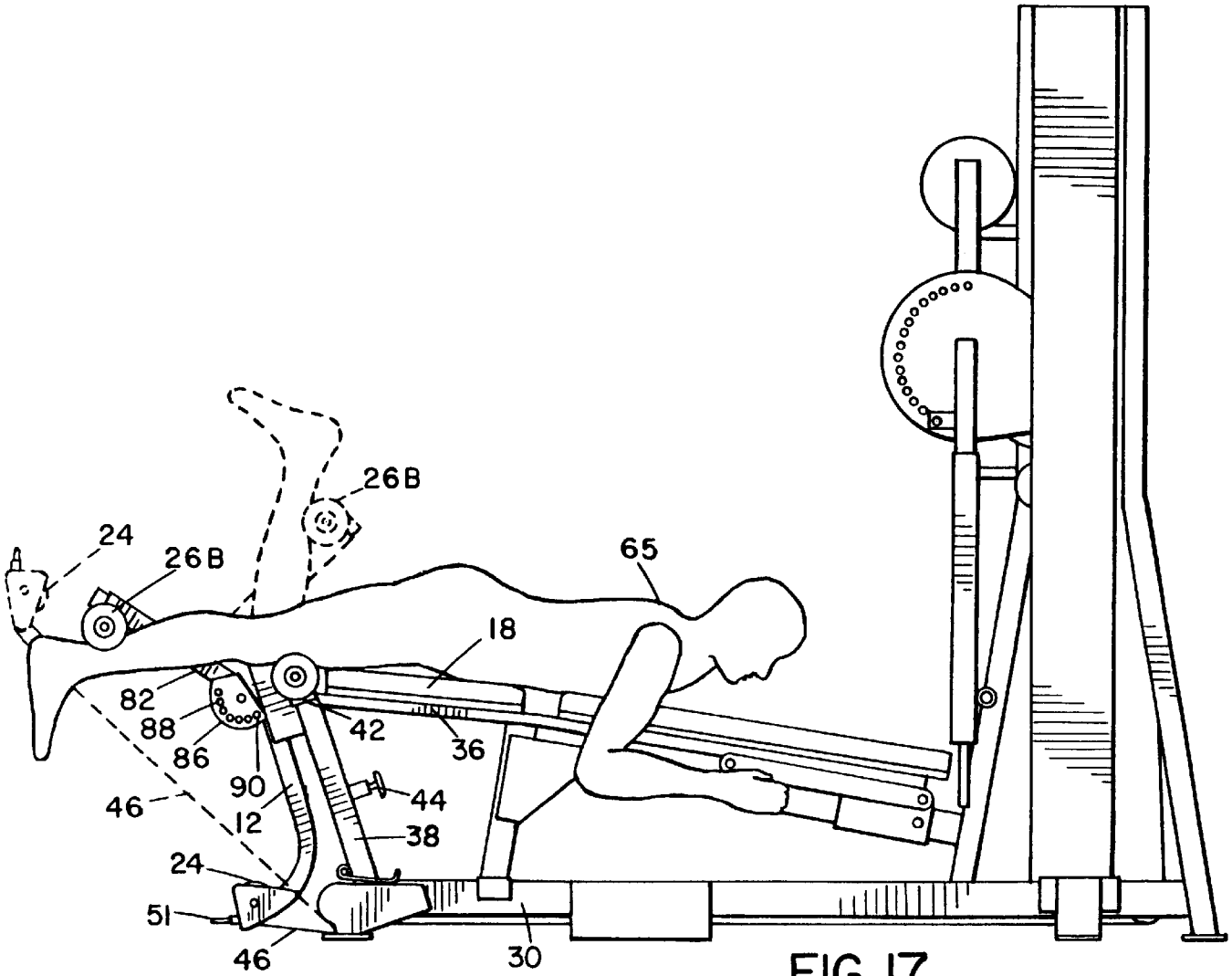
FIG. 17 is a side elevation view illustrating performance of a lying leg curl using the exercise arm of FIGS. 13 to 15.

FIG. 16B illustrates a position of arm 82 at an obtuse angle to arm 12, which may be used when the assembly is used to perform lying leg curls as in FIG. 17. As illustrated in FIG. 17, when the arm 82 is locked at a slightly upwardly inclined angle as in FIG. 16B, the user may lie prone on the seat pad 18 with roller pads 26A and 26B engaging behind the user's ankles. The user then bends the legs between the solid line position and the dotted line position illustrated in FIG. 17 in order to perform a leg curl exercise. The amount of pre-stretch when performing lying leg curls as in FIG. 17 can be adjusted by moving the pull pin 90 to a different, adjacent opening 88 in plate 86.

The assembly of FIGS. 13 to 17 therefore enables exercisers to perform more varied exercises than was possible in prior art arrangements. In addition to seated leg extensions, both standing and lying leg curls can be performed on the same machine. Standing leg curls are performed in the manner illustrated in FIG. 5, in the same way as in the first embodiment. Lying leg curls are performed as illustrated in FIG. 17. Lying leg curls are more traditional and are easier for the beginner, while standing leg curls work each leg independently for a more thorough workout. Each of these exercises requires the exerciser to engage the leg rollers 26A,26B at a different starting point.

FIG. 16C illustrates the exercise arm assembly 80 in a locked position, with the latch or hook 94 engaging over axle or tube 28. This allows the cable attachment 51 to be used to perform additional exercises, such as upright row exercises and preacher curls as in FIGS. 6 and 8, without moving the exercise arm.

The assembly of FIGS. 13 to 17 permits the leg roller pads to be adjusted independently from the load bearing exercise arm, allowing the exerciser to engage the leg roller pads at numerous different starting points. At the same time, the assembly can be held in a retracted, locked position to permit additional exercises to be performed by securing handles to the attachment point 51 provided at the end of cable 46. This assembly allows a large number of different exercises to be performed, including leg extensions, standing and lying leg curls, preacher curls, and upright rows, while permitting the starting position to be adjusted between a large number of different possible positions.

Figure 20:
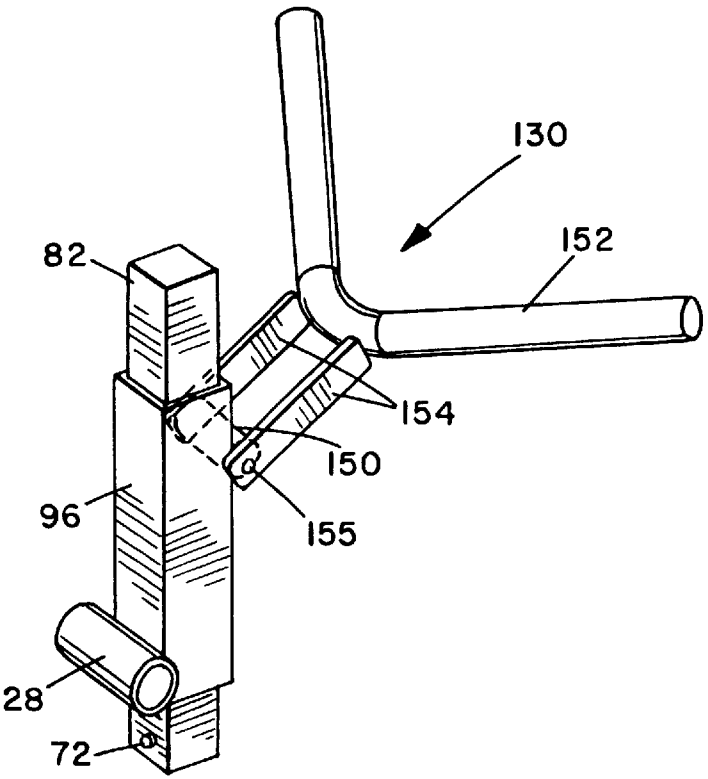
FIG. 20 is an exploded perspective view of the adjustable arm and handle attachment of FIG. 18.

FIGS. 18 to 20 illustrate a leg exercise arm assembly 100 according to another embodiment of the invention, which is similar to the previous embodiments but has the ability to adjust the entire arm assembly upwards to perform upright rows and preacher curls. Some parts in this embodiment are similar to those in the previous embodiments, and like reference numerals have been used for like parts as appropriate. As in the previous embodiment, a first arm 12 has a curved forward end portion 20 to which the load bearing cable 46 is linked via pulley 24, and the leg engaging roller pads 26A and 26B are secured to an adjustable arm 82 pivoted to the first arm 12 and secured in any desired orientation relative to arm 12 via range of motion plate 86. However, unlike the previous embodiment, the arm assembly 100 is not pivoted to a fixed point on the seat supporting portion of the machine frame. Instead, the upper end of arm 12 is pivoted via pin 102 between pivot brackets 104. Pivot brackets 104 are secured to the upper end of an adjustment shaft 106 extending through a sleeve 108 which is rigidly secured at the forward end of a strut 110 of the exercise machine frame. A pair of pulley brackets 112 are secured at the lower end of shaft 106, and a pulley 114 is rotatably secured between brackets 112. The cable 46 extends under pulley 114 and then under pulley 24 at the forward end of arm 12.

The exercise arm assembly 100 may be secured at various heights relative to the seat 18 and machine frame by sliding the shaft 106 up or down through sleeve 108. Shaft 106 is securable at various heights by means of a suitable locking device, such as a pull pin or tension knob 107. This allows the pivot point 102 on the exercise arm to be adjusted to the height of the exerciser for proper bio-mechanical alignment.

An upper roller assembly 116 is also pivoted between the brackets 104 on arm 106 via the same pivot pin 102 as the arm 12 in the version illustrated in FIG. 18. The upper roller assembly 116 comprises a roller pad mounting shaft 120 welded to a pair of swivel brackets 1 22 which in turn are pivoted to brackets 104 via pivot pin 102. A pair of roller pads 124A and 124B are mounted on the opposite ends of shaft 1 20. The roller pads 124A and 124B can therefore pivot about pivot pin 102 to adjust the height of these pads and thus the point of engagement with a user's legs. Stops 125,126 are provided to limit the swiveling motion of the pads 124A and 124B, and to prevent impact with brackets 104.

By moving the position of the pivot for the roller arm brackets 1 22 to pivot point 102' as in FIG. 19A, the end stops 125,126 may be eliminated.

The curved arm 12 may also be pivoted at point 102'. In this case, the upward and downward travel of the swiveling roller assembly 116 is limited by engagement of shaft 1 20 with the edges of the pivot brackets 104, eliminating the need for additional pivot stops. In another modification, the swiveling upper roller assembly 116 may be pivoted to the brackets 102 separately from the arm 12, at pivot points 118,102, respectively, as indicated in FIG. 19B. Pivot stops are also not necessary in this alternative, since the movement of the assembly 116 will again be limited by contact with the brackets 104.

As illustrated in FIGS. 18 and 20, a detachable handle device 130 is pivotally secured to the sleeve 96 on arm 82 by means of a pivot pin 132. A handle pivot tube 150 is welded to the front face of tube or sleeve 96, as best illustrated in FIG. 20. The handle device 1 30 basically comprises a bent, generally V-shaped handle 152 with a pair of parallel handle brackets 154 welded adjacent the apex to extend away from the handle 152 as illustrated. The brackets 154 engage over the opposite ends of pivot tube 150 and are pivotally secured to the tube 150 by means of pin 132 which extends through aligned openings 155 in the ends of the brackets and through tube 150. The pivot pin 132 is releasably secured in position, so that it may be readily removed to allow the handle to be taken off when not in use. The handle must be removably mounted since it would otherwise interfere with the exerciser's legs when performing various leg exercises.

This arrangement permits upper body exercises such as upright row and preacher curl exercises to be performed using the exercise arm itself, instead of the attaching a handle to the cable as in the previous embodiments. This is preferable since the exercise arm motion will help to guide the exerciser through the proper exercise range of motion. The ability to adjust the entire exercise arm assembly up and down by sliding shaft 106 through sleeve 108 is important since it allows the pivot point of the exercise arm to be properly aligned with that of the exerciser.

Figure 21:
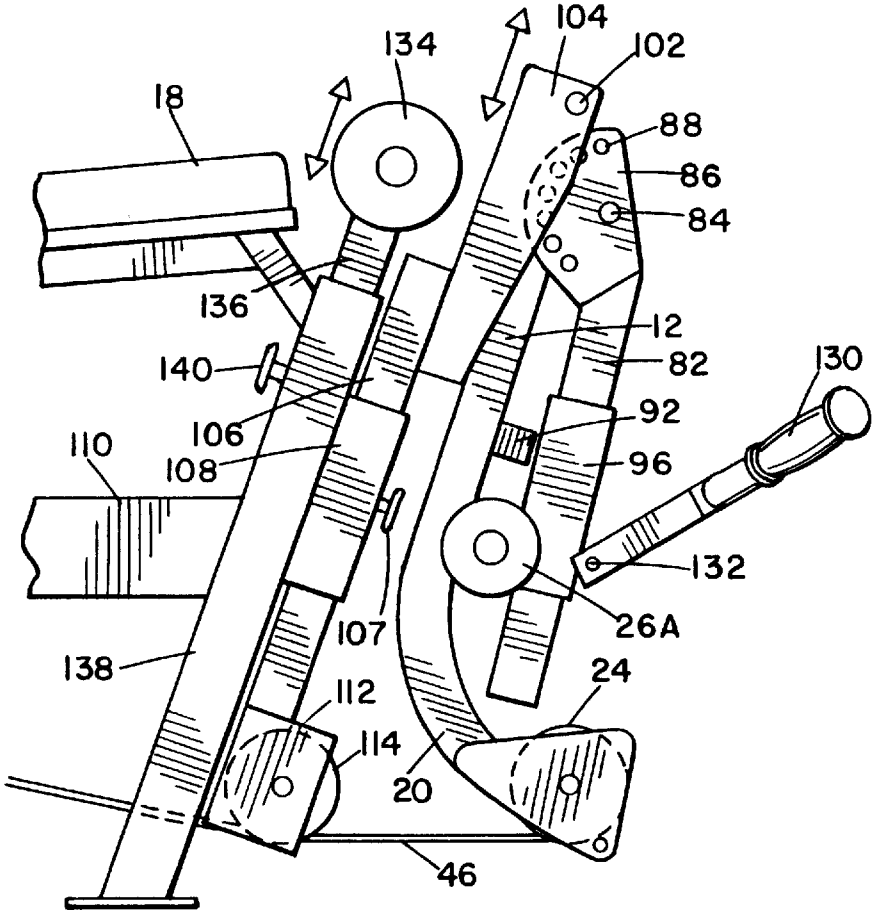
FIG. 21 is a side elevation view of a leg exercise arm assembly similar to FIG. 18 but with a modified arrangement for mounting the upper roller pads.
Figure 22:
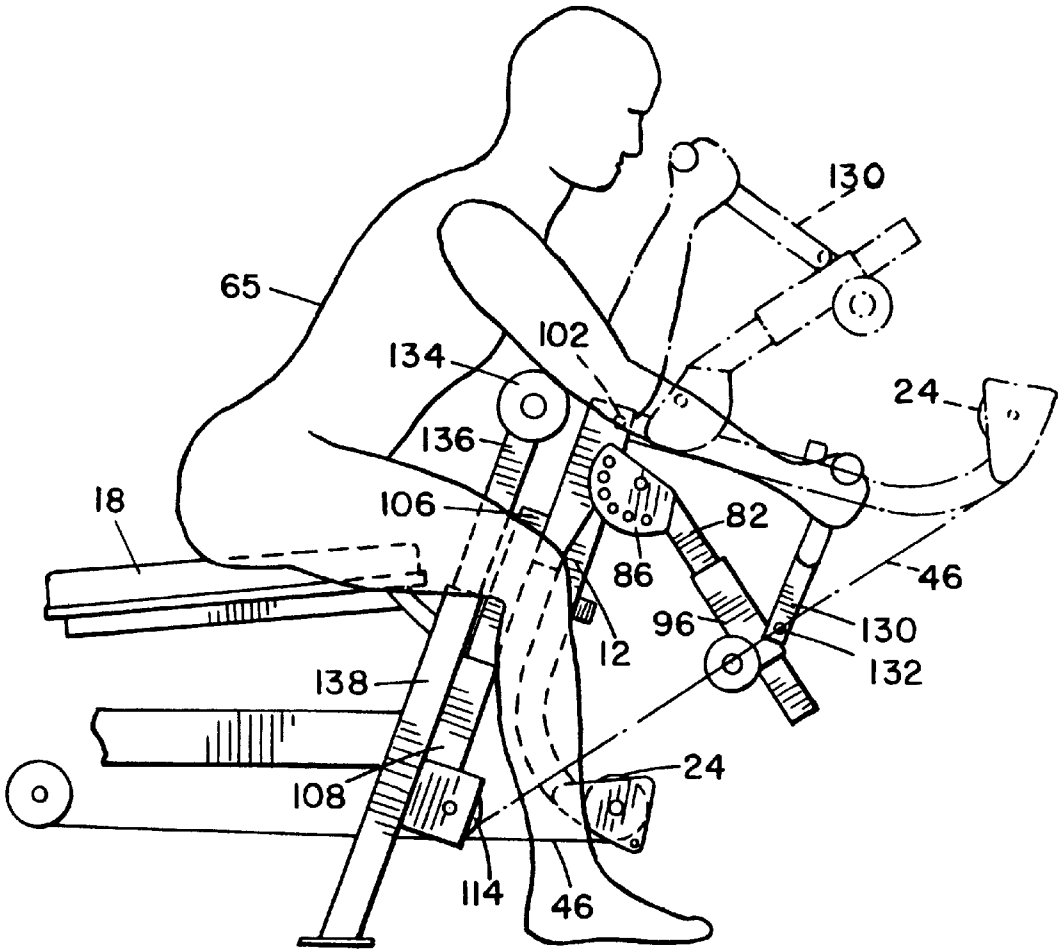
FIG. 22 is a side elevation view of the assembly of FIG. 21 illustrating use of the assembly to perform a preacher curl exercise.

FIGS. 21 and 22 illustrate a modified version of the embodiment of FIGS. 18 to 20, and like reference numerals have been used for like parts as appropriate. In this embodiment, as in the previous embodiment, the entire exercise arm assembly 100 is pivoted between a pair of brackets 104 at the upper end of an adjustable shaft 106 via pivot pin 102. Additionally, removable handle arm 130 may be pivotally mounted on the adjustment sleeve 96 of arm 82 via pivot 132, as in the previous embodiment. However, in this embodiment, the swiveling upper roller assembly of the previous embodiment is eliminated. Instead, a pair of upper roller pads 134 are mounted at the upper end of a telescoping shaft 136 which is in telescoping engagement in a rigid tubular strut 138 secured at the forward end of the seat supporting frame of the machine. The sleeve 108 through which shaft 106 slides is secured to the front side of strut 138. The upper roller pads 134 may be secured at any desired position or extension relative to the frame by means of a locking device such as a pull pin 140.

FIG. 22 illustrates use of the handle arm 130 and the upper rollers 134 in performing a preacher curl exercise. The exerciser 65 will be seated on seat 18, and will extend the rollers 134 to the optimum position for resting their upper arms on the roller pads as indicated. The roller pads are then locked in this position using pull pin 140. The exercise arm assembly 100 is raised by pulling shaft 106 upwardly through sleeve 108 until the pivot point 102 of arm 1 2 is substantially aligned with the user's elbow joint. The arm assembly is then locked in this position by pull pin 107.

The adjustable arm 82 is also adjusted by rotating about pivot 84 into the starting position or angle relative to curved arm 12 as illustrated in solid lines in FIG. 22, and is then locked in this position by extending pull pin 90 through the appropriate opening 88 on the ROM plate 86. The exerciser then grips the handles of handle arm 130, and pulls up to move the exercise arm assembly 100 between the starting position illustrated in solid lines and the extended position illustrated in dotted lines in FIG. 21. The support provided by roller pads 134 throughout this movement will assist the user in performing this exercise. The alignment of the exercise arm assembly pivot 102 with the pivot point of the exerciser's elbow, as illustrated in FIG. 22, ensures correct bio-mechanics when performing the illustrated preacher curl exercise.

Although the handle arm 130 is pivotally mounted on the adjustment sleeve 96 for the leg engaging roller pads 26A and 26B in the embodiments illustrated in FIGS. 18 to 22, several alternative arrangements are possible. In one alternative, the roller pads 26A and 26B are secured to the lower end of shaft 82, as in FIGS. 14 and 15, and the handle arm 130 is then releasably pivoted directly to the front side of shaft 82 at a location spaced above the roller pads 26A and 26B. In another possible alternative, the handle arm 130 may be releasably pivoted directly to the shaft 82 in FIGS. 18 to 22, instead of to the adjustment sleeve 96 as illustrated. The arm 130 may be pivoted to shaft 82 above or below the adjustment sleeve 96.

Figure 23:
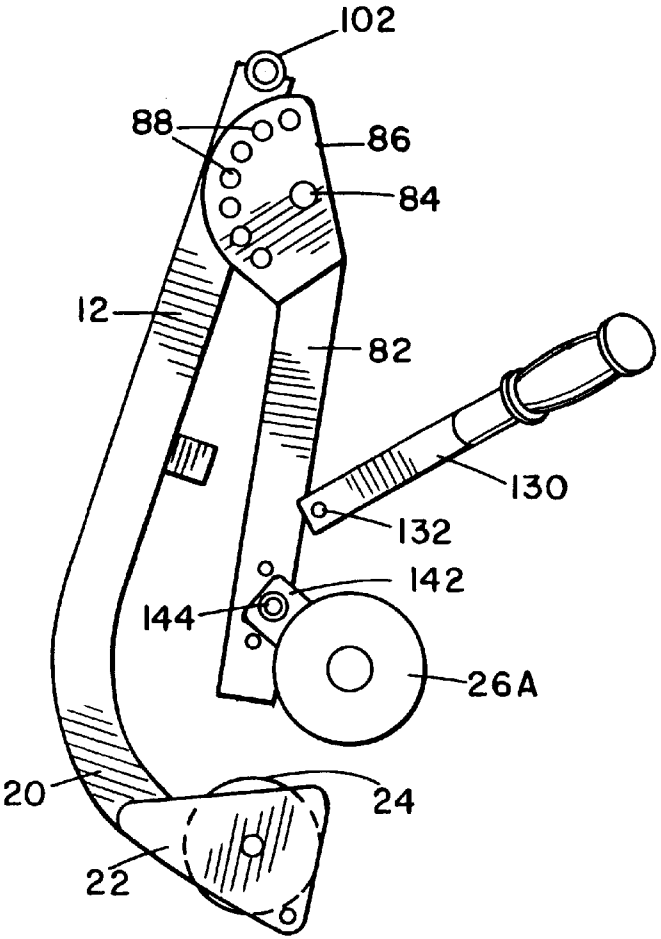
FIG. 23 is a side elevation view similar to FIG. 21 illustrating another modification.

Another possible arrangement of the removable handle arm is illustrated in FIG. 23. In this alternative, the leg engaging roller pads 26A and 26B are pivotally mounted on shaft 82 by means of swivel brackets 142 which are pivotally secured to shaft 82 via pivot pin 144, in a similar arrangement to that of FIG. 12. In this case, the handle device 130 is releasably pivoted to the front side of shaft 82 via pivot pin 132 at a location spaced above the pivoting roller pads 26A and 26B.

Thus, the pivot tube 150 for the releasable handle may be welded to the front of the roller pad adjustment sleeve 96 or directly to the front of the adjustable arm 82, where the pads 26A and 26B are rigidly secured to arm 82 or secured via a swivel assembly, or where they are secured via adjustment sleeve 96. In every case, the handle device is releasably mounted and is only mounted on arm 82 when the user wishes to perform upper body exercises, for example preacher curls as illustrated in FIG. 22.

The exercise arm assembly of the above embodiments provides a forwardly curving exercise arm with a pulley mounted to the forward end of the exercise arm, placing the cable attachment point for additional exercises out in front of the exercise arm for easier access to perform other exercises in which a handle is attached to the cable. The movement of the cable attachment point forwardly from the exercise arm also reduces the risk of the cable hitting the exercise arm or any attachments mounted on the arm during exercises, which could potentially damage the cable. Additionally, the forwardly curved end portion provides a surface for the cable to wrap around during the second half of an exercise movement, keeping a constant pull on the cable and preventing resistance drop off.

The embodiments with a range of motion adjustment of the leg engaging roller pads relative to the curved exercise arm carrying the load bearing cable permit a larger number of different exercises to be performed with the exerciser in different positions. They have the added advantage of allowing adjustment of the starting position of the exerciser for performing any specific exercise, to vary the pre-stretch in order to accommodate less experienced exercisers and older or injured individuals with less muscle and joint flexibility. Finally, by adding a removable handle device attached directly to the exercise arm assembly, rather than to the cable, the exercise arm itself may be used in performing upper body exercises, guiding the exerciser through the proper range of motion and obtaining more correct biomechanical alignment.

Although some preferred embodiments of the invention have been described above by way of example only, it will be understood by those skilled in the field that modifications may be made to the disclosed embodiments without departing form the scope of the invention, which is defined by the appended claims.

I claim:

1. An apparatus for performing exercises, comprising:

a support frame having a forward end and a rear end and an upright strut adjacent the rear end;

a seat mounted on the support frame in front of the upright strut, the seat having a forward end;

an exercise arm having opposite first and second ends, the first end being pivoted to the support frame adjacent the forward end of the seat for swinging back and forth in front of the seat about a first pivot axis;

the arm having an integral curved portion adjacent the second end which curves forwardly towards the forward end of the frame in a direction away from the seat and upright strut over the entire length of the curved portion up to the second end of the arm;

a pulley mounted at the second end of the arm and spaced forwardly from the forward end of the seat and the remainder of the arm, the pulley comprising means for engagement with a load bearing cable; and a leg engaging assembly attached to the arm and spaced above the curved portion of the arm, the leg engaging assembly comprising a pair of oppositely directed leg engagement members for engagement by the legs of a user on opposite sides of the arm.

2. The apparatus as claimed in claim 1, wherein the leg engagement members comprise a pair of oppositely directed roller pads secured to the arm above the curved portion of the arm.

3. The apparatus as claimed in claim 2, including a sliding sleeve slidably mounted for free sliding movement up and down over the arm above the curved portion, the roller pads being secured to the sliding sleeve for free sliding adjustment of the position of the roller pads on the arm with no releasable attachment for securing the sleeve at any fixed position on the arm.

4. The apparatus as claimed in claim 3, including a stop member on the arm adjacent the curved portion for preventing movement of the sliding sleeve onto the curved portion.

5. The apparatus as claimed in claim 1, including a hinge member pivotally secured to the arm above the curved portion for rotation about a second pivot axis transverse to the arm, the second pivot axis being spaced above the curved portion towards the first end of the arm, the roller pads being secured to the hinge member for rotating up and down about the second pivot axis to adjust the roller pad position on the arm.

6. The apparatus as claimed in claim 5, including first and second stop members on the arm above and below said second pivot axis, respectively, for restricting rotation of said hinge member beyond a predetermined point in each direction.

7. The apparatus as claimed in claim 1, including a pair of upper roller pads secured at the front end of the seat for engaging upper portions of an exerciser's legs while using the exercise arm.

8. The apparatus as claimed in claim 7, wherein the support frame includes a fixed tubular member extending upwardly adjacent the forward end of the seat, the tubular member having an op en upper end, a shaft telescopically engaging said tubular member and extending upwardly out of the open end, and the upper roller pads being secured to said shaft.

9. The apparatus as claimed in claim 1, wherein the support frame includes a rigid, upwardly extending strut at the forward end of the seat, the exercise arm being pivotally secured to said strut.

10. The apparatus as claimed in claim 9, wherein the strut has an upper end and a pair of upper roller pads secured to the upper end of the strut.

11. The apparatus as claimed in claim 10, wherein the upper roller pads are adjustably secured to the upper end of the strut.

12. The apparatus as claimed in claim 1, including a load bearing cable extending around the pulley at the forward end of the curved portion of the exercise arm, the cable having a forward end in front of the pulley, a stop on the forward end of the cable for preventing retraction of the cable end off the pulley, and an attachment device on the forward end of the cable for releasable attachment of a handle device to the cable.

13. The apparatus as claimed in claim 1, including an elongate adjustment arm pivotally secured adjacent the first end of the first arm for rotation about a second pivot axis parallel to the first pivot axis, and a releasable range of motion assembly for releasably locking the adjustment arm at a selected orientation relative to said exercise arm, the leg engaging assembly being secured to said adjustment arm.

14. The apparatus as claimed in claim 13, wherein the range of motion assembly comprises a first member comprising a plate having a series of spaced holes on an arc centered on said second pivot axis, and a second member comprising a pin for releasable engagement in a selected one of said holes, one of said members being mounted on said adjustment arm and the other of said members being mounted on said exercise arm.

15. The apparatus as claimed in claim 13, wherein the leg engaging assembly is adjustably secured to said adjustment arm.

16. The apparatus as claimed in claim 15, including a sliding sleeve slidably mounted on the adjustment arm for free sliding movement along at least part of the length of the arm, the leg engaging assembly being secured to said sliding sleeve.

17. The apparatus as claimed in claim 13, including a handle assembly and a pivot device for releasably mounting the handle assembly on said adjustment arm for rotation about a third pivot axis relative to the adjustment arm.

18. The apparatus as claimed in claim 17, wherein the pivot device comprises a pivot tube secured to the adjustment arm and a pivot pin for releasable pivotal engagement in the tube to pivotally secure the handle assembly to the arm.

19. The apparatus as claimed in claim 18, wherein the pivot tube is secured directly to the arm.

20. The apparatus as claimed in claim 18, including a sleeve slidably mounted on the adjustment arm, the pivot tube being secured to the sleeve.

21. The apparatus as claimed in claim 1, wherein a slider member is slidably mounted on the frame at the forward end of the seat, the exercise arm being pivotally mounted on the slider member and the slider member being movable up and down to adjust the height of the exercise arm.

22. The apparatus as claimed in claim 21, wherein the frame includes a tube adjacent the forward end of the seat extending in a generally upwards direction, and the slider member comprises an elongate shaft having opposite upper and lower ends and extending slidably through said tube, the first end of the exercise arm being pivotally secured to the upper end of said shaft.

23. The apparatus as claimed in claim 22, including a second pulley rotatably mounted at the lower end of said shaft, and a load bearing cable extending at least partially around said second pulley and the pulley at the second end of said exercise arm.

24. The apparatus as claimed in claim 22, including a releasable locking member for releasably locking the shaft at a selected position relative to said tube.

25. The apparatus as claimed in claim 22, including a pair of upper roller pads secured to the upper end of said shaft.

26. The apparatus as claimed in claim 25, including a roller pivot member pivotally secured to the upper end of said shaft, the upper roller pads being secured to said roller pivot member.

27. The apparatus as claimed in claim 22, wherein the support frame includes a fixed tubular strut extending upwardly adjacent the forward end of the seat, the tube being secured to said tubular strut, the tubular strut having an open upper end, a shaft telescopically engaging in the open upper end of said strut, and a pair of upper roller pads being secured to said shaft.

28. The apparatus as claimed in claim 1, including a load bearing cable having a first end extending around the pulley at the second end of the arm and a second end for securing to a load, the pulley at the second end of the arm comprising the only cable-engaging pulley on the arm, a second pulley mounted on the support frame, the cable extending from the pulley at the second end of the arm directly to the second pulley, whereby the curved portion of the arm acts as a cam and the cable wraps around the curved portion as the arm is pivoted forwardly away from the seat.

29. An apparatus for performing exercises, comprising:

a support frame having a base with a forward end and a rear end, and an upright strut extending upwardly from the base at a location between the rear and forward ends;

a seat mounted on the support frame in front of the upright strut facing the forward end of the base, the seat having a forward end;

an exercise arm having opposite first and second ends, the first end being pivoted to the support frame adjacent the forward end of the seat for swinging back and forth in front of the seat about a first pivot axis;

the exercise arm having a first, straight arm portion extending from the first end of the arm over a first portion of the length of the arm, and a second, curved portion extending over a second portion of the length of the arm from the straight portion to the second end of the arm, the first portion being longer than the second portion, the curved portion curving forwardly in a direction away from the seat and upright strut and towards the forward end of the base over the entire length of the curved portion, whereby the second end of the arm is spaced forwardly from the first, straight portion of the arm;

a pulley mounted at the second end of the arm and spaced forwardly from the first, straight portion of the arm and in front of the seat, the pulley comprising means for engagement with a load-bearing cable; and a leg engaging assembly attached to the straight portion of the arm and spaced above the curved portion of the arm, the leg engaging assembly comprising a pair of oppositely directed leg engagement members for engagement by the legs of a user on opposite sides of the arm.

30. An apparatus for performing exercises, comprising:

a support frame having a base with a forward end and a rear end, and an upright strut extending upwardly from the base adjacent the rear end;

a seat mounted on the support frame forwardly of the upright strut, the seat having a forward end facing the forward end of the frame;

an exercise arm having opposite first and second ends, the first end being pivoted to the support frame adjacent the forward end of the seat for swinging back and forth in front of the seat about a first pivot axis;

the arm having a curved portion adjacent the second end which curves forwardly in a direction away from the seat and upright strut and towards the forward end of the base over the entire length of the curved portion;

a first pulley mounted at the second end of the arm and spaced forwardly of the remainder of the arm;

a load bearing cable having a first end extending around the first pulley at the second end of the arm and a second end for securing to an exercise resistance;

a second pulley mounted on the support frame;

the cable extending from the first pulley directly to the second pulley;

the curved portion of the arm comprising means for guiding the cable around the curved portion as the arm is pivoted forwardly away from the seat; and a leg engaging assembly attached to the arm and spaced above the curved portion of the arm, the leg engaging assembly comprising a pair of oppositely directed leg engagement members for engagement by the legs of a user on opposite sides of the arm.

* * * * *